United States Patent [19]

Bean

[11] 4,103,994

[45] Aug. 1, 1978

[54] RECORDING PLATE

[75] Inventor: Lloyd F. Bean, Rochester, N.Y.

[73] Assignee: Xerox Corporation, Stamford, Conn.

[21] Appl. No.: 767,706

[22] Filed: Feb. 11, 1977

[51] Int. Cl.[2] ..... G03G 15/00

[52] U.S. Cl. ..... 355/3 R; 346/160; 355/3 DD

[58] Field of Search ..... 355/3 R, 3 DR, 3 DD; 96/1 R, 1 PC, 1 E; 346/160, 153

[56] References Cited

U.S. PATENT DOCUMENTS

| | | | |
|---|---|---|---|
| 3,288,602 | 11/1966 | Snelling et al. | 355/3 R |
| 3,426,354 | 2/1969 | Gundlach | 346/160 |

*Primary Examiner*—Richard L. Moses

*Attorney, Agent, or Firm*—J. J. Ralabate; C. A. Green; H. Fleischer

[57] ABSTRACT

An image recording member in which a pair of conductive members are disposed in a photoconductive member contiguous with a support member. Each of the conductive members has an insulating coating thereon for electrical isolation thereof. An electrical potential is applied to one of the conductive members for creating a potential difference between the pair of conductive members. This forms an electrical field through the photoconductive member.

12 Claims, 4 Drawing Figures

RECORDING PLATE

BACKGROUND OF THE INVENTION

This invention relates generally to an electrophotographic printing machine, and more particularly concerns a recording member employed therein.

In the process of electrophotographic printing, a photoconductive member is charged to a substantially uniform level and exposed to a light image of an original document being reproduced. The light image discharges the photoconductive member in the irradiated areas to record an electrostatic latent image thereon. Thereafter, charged particles are attracted to the latent image so as to form a powder image on the photoconductive surface. The powder image is then transferred to a sheet of support material, i.e. the copy paper, in image configuration. The powder image adhering to the copy paper is then heated permanently affixing it thereto. This process is more fully described in U.S. Pat. No. 2,297,691 issued to Carlson in 1942 and further amplified by many other related patents in the art.

Since the time of the original disclosure of this process, the photoconductive member has required charging. Typically, this is accomplished by a corona generating device which sprays ions onto the photoconductive surface to achieve a substantially uniform charge thereon. Particles employed to develop the electrostatic latent image must have the correct polarity so as to be attracted thereto. It has become advantageous to both eliminate the charging process and to utilize uncharged insulating particles for the development process. One such approach modifies the recording member so as to eliminate the requirement for the charging step in the electrophotographic printing process. The foregoing is described in U.S. Pat. No. 3,288,602 issued to Snelling et al in 1966. This patent discloses one embodiment of a xerographic plate including a photoconductive layer adhering to a dielectric layer. Conductors are disposed in the dielectric layer contiguous with a support layer which is secured to the dielectric layer. The support layer or base may be insulating. An alternate embodiment is of a xerographic plate comprising a photoconductive layer having conductors disposed therein and contiguous with a dielectric layer adjacent to the photoconductive layer. A conductive layer, in turn, is secured to the dielectric layer. The dielectric layer is interposed between the photoconductive layer and the conductive layer. In both of the foregoing embodiments, an electrical potential is applied to the conductors so as to form a potential difference therebetween. This establishes an electrical field in the xerographic plate. A light image dissipates the electrical field in the irradiated areas to form a latent image which may be developed in the manner of all electrophotographic printing machines.

The structure of the present invention achieves a voltage varying pattern which attracts and holds uncharged insulating particles thereto. This structure is significantly improved over the prior art and attains higher resolution than was heretofore achievable.

Accordingly, it is a primary object of the present invention to improve the recording member employed in an electrophotographic printing machine so as to form a latent image thereon corresponding to an original document being reproduced which attracts and secures thereto uncharged insulating particles.

SUMMARY OF THE INVENTION

Briefly stated and in accordance with the present invention, there is provided an image recording member.

Pursuant to the features of the invention, the recording member includes a support member having a photoconductive member contiguous therewith. At least a pair of conductive members are disposed in the conductive member. Each of the conductive members has an insulating coating thereon for electrical isolation. Means are provided for generating an electrical potential difference between the conductive members. In this manner, an electrical field is formed in the recording member.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary it is intended to cover all alternatives, modifications and equivalents as may be included within the spirit and scope of the invention as defined by the appended claims.

DETAILED DESCRIPTION OF THE INVENTION

Figure 1:
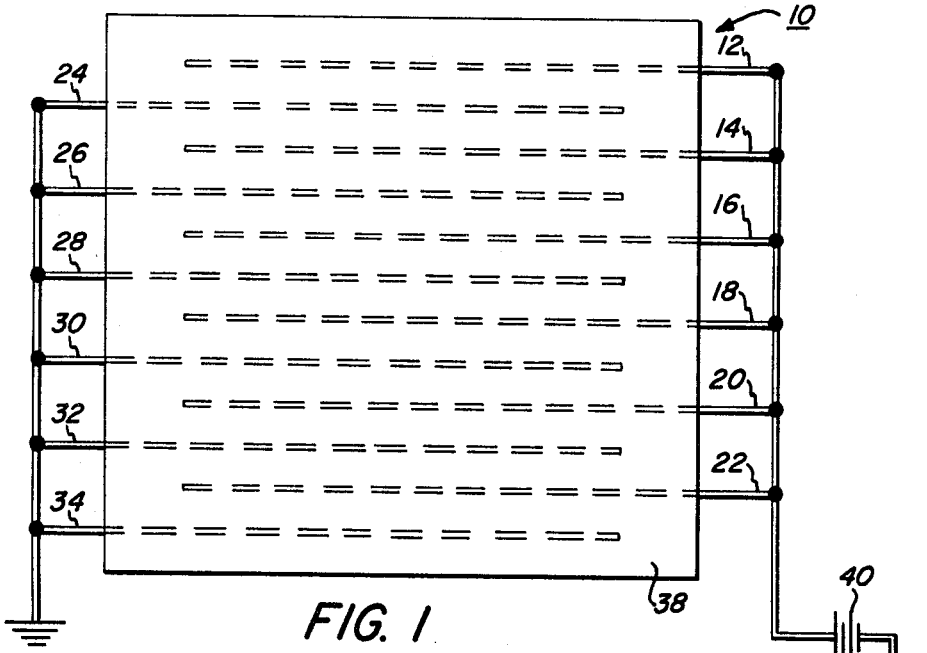
FIG. 1 is a plan view of a recording member employed in an electrophotographic printing machine.

With continued reference to the drawings wherein like reference numerals have been used throughout to designate identical elements, FIG. 1 illustrates a recording member or plate particularly well adapted for use in an electrophotographic printing machine. However, it should become evident from the following discussion that it is equally well suited for use in a wide variety of electrostatographic printing machines and is not necessarily limited in its application to the particular embodiment shown herein.

Referring now to FIG. 1, recording member 10 comprises a number of slender conductors 12, 14, 16, 18, 20, 22, 24, 26, 28, 30 and 32 which run substantially in parallel lines across the width thereof. Each conductor has an insulating coating 36 (FIG. 2) entrained thereabout. The conductors with the insulating coatings thereon are disposed or embedded in photoconductive surface 38. These conductors are thin and uniformly spaced so as to form two fine conductive grid patterns. It should be noted that more than two fine grid patterns may be employed, but at least two are required in this process, to establish the appropriate electrical field. The conductors are uniformly spaced and there are anywhere from 75 to 350 conductors per inch of plate, although more or less conductors per inch may also be employed. The conductors occupy about 50 percent of the surface area of the plate. Each conductor is covered with an insulating coating 36 to prevent electrical conductivity therebetween. One of the sets of conductors or fine grid patterns is connected to potential source or voltage supply 40 while the other set of conductors is electrically grounded. An electrical field, as shown in FIG. 2, is established between conductors.

Figure 2:
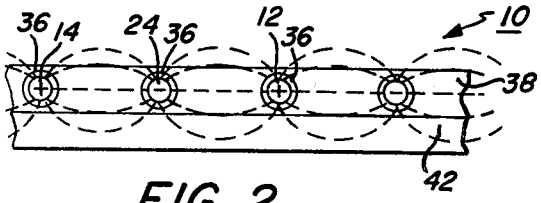
FIG. 2 is a fragmentary sectional view of the FIG. 1 recording member depicting the electrical field thereof.

Referring now to FIG. 2, recording member 10 includes a support member 42 having a photoconductive layer 38 contiguous with and secured thereto. The conductors are embedded in photoconductive layer 38. As shown in FIG. 2, conductors 14, 12 and 24 are embedded in photoconductive layer 38. Each of these conductors has an insulating coating 36 thereon. When voltage source 40 is connected to conductors 12 and 14, an electrical field is generated through recording member 10.

Figure 3:
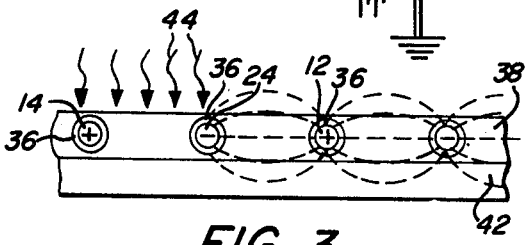
FIG. 3 is a fragmentary sectional view of showing the FIG. 2 electrical field in the Figure recording member after a portion thereof is illuminated.

Referring now to FIG. 3, after the electrical field is generated in recording member 10, light rays 44 are then projected thereon. The illuminated areas of photoconductive layer 38 are rendered conductive. As is well known, an electrical field when applied to a conductor causes free electrons within it to move in such as way as to make the interior of the conductor a field free, equipotential volume. In this case, when the area of the photoconductive layer 38 positioned above conductors 14 and 24 is illuminated, or subjected to other types of activating electromagnetic radiation, the electric field resulting from the application of the potential across conductors 14 and 24 causes the free electrons within this conductive area of photoconductive layer 38 to move towards the positive conductor 14 leaving the area above the negative conductor 24 relatively positive. This results in the electric field between conductors 14 and 24 being substantially dissipated. As previously noted, support base 42 may either be a conductive layer or a insulating layer. Thus, it is evident that illumination of the recording member 10 creates a latent image corresponding to the original document being reproduced. The theoretical operation of this type of recording member is more fully described in U.S. Pat. No. 3,288,602, issued to Snelling et al in 1966, the relevant portions thereof being hereby incorporated into the present application.

As shown in FIG. 3, the resultant electrical field remains only in the non-illuminated areas and corresponds to the informational regions contained within the original document. This field will attract uncharged insulating particles thereto. Hence, recording member 10 may be developed, after exposure to a light image of the original document, with uncharged insulating particles.

By way of example, support base 42 may be formed from a Mylar sheet if it is to be insulative. Photoconductive layer 38 is preferably made from vitreous selenium. The insulated conductive grids disposed in photoconductive layer 38 could be formed by a photoresist process with the selenium layer being coated thereabout. Alternatively, support member 42 may be conductive and made from an aluminum plate.

Figure 4:
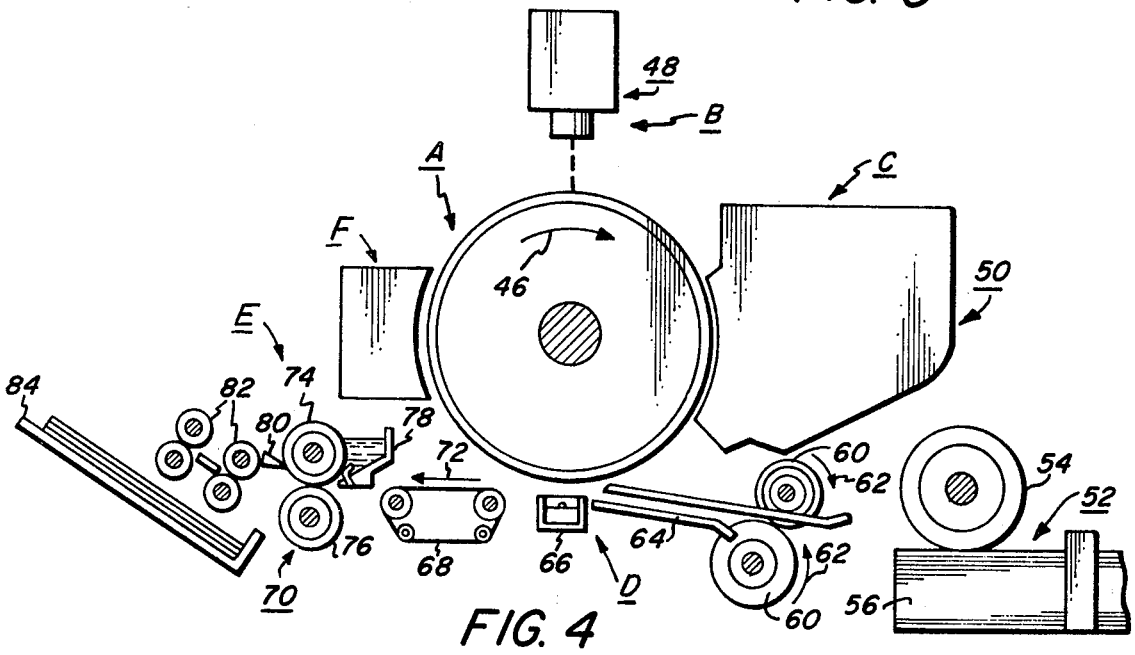
FIG. 4 shows an electrophotographic printing machine employing the FIG. 1 recording member in a drum configuration.

Referring now to FIG. 4, there is shown an electrophotographic printing machine in which the recording plate of FIGS. 1 through 3, inclusive, may be incorporated. FIG. 4 schematically illustrates the various components of an electrophotographic printing machine adapted to employ the features of the present invention therein.

As shown in FIG. 4, the printing machine employs a drum 44 which is a recording member of the type shown in FIGS. 1 through 3, inclusive. A synchronous speed motor (not shown) rotates drum 44 in the direction of arrow 46. As drum 44 rotates, a portion thereof passes sequentially through a series of processing stations. These processing stations will be described hereinafter briefly.

Initially, an electrical potential is applied to drum 44. This may be achieved by a segmented slip ring assembly. Thus, for each complete rotation of drum 44 the potential is applied thereto at station A and removed therefrom just prior thereto. After drum 44 has an electrical potential applied thereto, it rotates to exposure station B.

At exposure station B, exposure mechanism 48 projects a light image of the original document being reproduced thereon. Exposure mechanism 48 includes a stationary housing for supporting an original document. The housing comprises a transparent platen upon which the original document is positioned. Lamps illuminate the original document. Scanning of the original document is achieved by oscillating a mirror in a timed relationship with movement of drum 44, or in lieu thereof, by moving the lamp and lens system to form a flowing light thereof. The light image of the original document is projected onto drum 44. In this manner, drum 44 is selectively irradiated so as to dissipate the electrical field and record thereon a latent image corresponding to the informational areas contained within the original document.

Next, the latent image recorded on drum 44 is rotated to development station C. At development station C, a developer unit 50 having a housing with a supply of developer material contained therein renders the latent image visible. The developer material comprises uncharged insulating particles. Typically, these particles have a resistivity ranging from about $10^{14}$ to about $10^{17}$ ohm-cm. By way of example, these particles may be formed from a magnetic material, i.e. core, having an insulating coating thereon. The developer material is brought through a directional flux field forming a brush thereof. The voltage pattern on drum 44, i.e. the latent image thereon, attracts the uncharged insulating particles from the development system to form a powder image on the surface of drum 44. In this manner, a single component developer material may be employed and carrier particles are not required. Thus, the materials employed to develop the latent image or voltage bearing pattern is uncharged insulating particles which have a magnetic core therein. Preferably, the magnetic brush development system comprises a stationary magnet having a rotating non-magnetic sleeve telescoped thereover which advances the magnetic uncharged insulating particles from a sump to the development zone closely adjacent to the latent image recorded on drum 44. The electrical field of drum 44 attracts the uncharged insulating particles thereto rendering the latent image visible.

After development, a corona generating device (not shown) sprays ions onto the particles. This pre-conditions the particles preparatory to their being transferred to a sheet of support material.

Referring now briefly to the sheet feeding path, a sheet of support material is advanced by sheet feeding apparatus 52 to transfer station D. Sheet feeding apparatus 52 includes a feed roll 54 contacting the uppermost surface of the stack of sheets of support material 56.

Feed roll 54 rotates in the direction of arrow 58 to advance the uppermost sheet from stack 56. Registration rollers 60, rotating in the direction of arrow 62, align and forward the advancing sheet of support material into chute 64. Chute 64 directs the advancing sheet of support material into contact with drum 44 in a timed relationship so that the powder image developed thereon contacts the advancing sheet of support material at transfer station D.

Transfer station D includes a corona generating device 66, for spraying ions into the backside of the sheet of support material, i.e. the side opposed from drum 44. The powder image adhering to drum 44 is then attracted therefrom to the surface of the sheet of support material in contact therewith. After transferring the powder image to the sheet of support material, endless belt conveyor 68 advances the sheet of support material to fixing station E.

Fixing station E includes a fuser assembly, indicated generally by the reference numeral 70. The sheet of support material advances in the direction of arrow 72 into a nip defined by fuser roller 74 and backup roller 76 of fuser assembly 70. Fuser roller 74 is preferably heated with the sheet of support material having the powder image thereon in contact therewith. A release material applicator 78 supplies release material to fuser roller 74. Metering blade 80 regulates the quantity of release material applied to fuser roller 74. The insulating particles deposited on the sheet of support material in image configuration are heated by fuser roller 74 so as to be permanently affixed to the sheet of support material. After the fusing process, rollers 82 advance the sheet of support material with the powder image permanently affixed thereto to catch tray 84 for subsequent removal therefrom by the machine operator.

Invariably, residual particles remain adhering to drum 44 after the transfer of the powder image to the sheet of support material. These residual particles are removed from drum 44 at cleaning station F. Prior to the removal of the residual particles, the remaining electrical field on drum 44 is removed therefrom and the conductors grounded. Thus, the segmented slip ring assembly is adjusted so as to no longer apply a voltage to drum 44 at this point. Drum 44 is illuminated. The particles are then removed from drum 44 by a rotatably mounted fibrous brush in contact therewith. After cleaning, the slip ring assembly once again applies a voltage to drum 44 to re-establish the electrical field thereon so that the next imaging cycle may be re-initiated.

In recapitulation, it is evident that a recording member employed in an electrophotographic printing machine has an electrical field produced thereon by applying a voltage thereto. This electrical field is selectively dissipated when the recording member is exposed to a light image of an original document being reproduced. The resultant electrical field or latent image attracts uncharged insulating particles thereto so as to form a powder image on the surface of the recording member. Thereafter, the powder image is transferred to a sheet of support material and permanently affixed thereto producing a copy of the original document being reproduced.

It is, therefore, evident that there has been provided, in accordance with the present invention, a recording member for use in an electrophotographic printing machine which has an electrical field formed thereon in image configuration for attracting uncharged insulating particles thereto. This recording member may be employed in an electrophotographic printing machine and fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An image recording member, including:

a support member;

a photoconductive layer contiguous with said support member;

at least a pair of conductive members embedded in said photoconductive layer with each of said conductive members being spaced from one another and having an insulating coating thereon for electrical isolation thereof; and means for generating an electrical potential difference between said pair of conductive members so as to form an electrical field in said photoconductive layer.

2. A recording member as recited in claim 1, wherein said pair of conductive members includes a first conductive member comprising a first fine conductive grid pattern.

3. A recording member as recited in claim 2, wherein said pair of conductive members includes a second conductive member comprising a second fine conductive grid pattern spaced from said first fine conductive grid pattern.

4. A recording member as recited in claim 3, wherein said support member includes an insulating layer.

5. A recording member as recited in claim 3, wherein said support member includes a conductive layer.

6. An electrophotographic printing machine including:

a recording layer comprising a support member, a photoconductive member contiguous with the support member, at least a pair of conductive members embedded in the photoconductive member with each of the conductive members being spaced from one another and having an insulating coating thereon for electrical isolation thereof, and means for generating an electrical potential difference between the pair of conductive members so as to form an electrical field in the photoconductive layer; and means for exposing said recording member to a light image of an original document being reproduced so that the electrical field in the illuminated regions of the photoconductive layer collapses forming a latent image therein corresponding to the original document.

7. A printing machine as recited in claim 6, wherein the pair of conductive members of said recording member includes a first conductive member comprising a first fine conductive grid pattern.

8. A printing machine as recited in claim 7, wherein the pair of conductive members of said recording member includes a second conductive member comprising a second fine conductive grid pattern spaced from the first fine conductive grid pattern.

9. A printing machine as recited in claim 8, wherein the support member of said recording member includes an insulating layer.

10. A printing machine as recited in claim 8, wherein the support member of said recording member includes a conductive layer.

11. A printing machine as recited in claim 8, further including means for depositing uncharged insulating particles on said recording member in image configuration.

12. A printing machine as recited in claim 11, further including:

means for transferring the particles from said recording member to a sheet of support material; and means for affixing substantially permanently the particles to the sheet of support material so as to form a copy of the original document.

* * * * *